US005190587A

United States Patent [19]

Sakai

[11] Patent Number: 5,190,587

[45] Date of Patent: Mar. 2, 1993

[54] SINGLE-LINE PARTS COATING SYSTEM

[75] Inventor: Hideyuki Sakai, Okazaki, Japan

[73] Assignees: Nichidai Industrial Co. Ltd., Aichi; Daiwa Paint Trading Co. Ltd., Nagoya, both of Japan

[21] Appl. No.: 884,419

[22] Filed: May 18, 1992

Related U.S. Application Data

[62] Division of Ser. No. 689,327, Apr. 23, 1991, Pat. No. 5,150,655.

[30] Foreign Application Priority Data

Apr. 24, 1990 [JP] Japan ..... 2-108220

[51] Int. Cl.[5] ..... B61B 7/00

[52] U.S. Cl. ..... 118/324; 104/89; 104/106; 104/93

[58] Field of Search ..... 104/89, 93-95, 104/106, 111; 238/1, 10 C, 10 R, 15, 122; 198/838, 861.2; 118/324

[56] References Cited

U.S. PATENT DOCUMENTS

| | | | |
|---|---|---|---|
| 2,208,269 | 7/1940 | Cartlidge | 198/861.2 |
| 2,795,315 | 6/1957 | Hahir | 198/861.2 |
| 4,139,087 | 2/1979 | Westhoff | 198/861.2 |
| 4,144,965 | 3/1979 | Alldredge | 198/861.2 |
| 5,043,052 | 8/1991 | Sakai | 104/94 |
| 5,060,594 | 10/1991 | Tomioka et al. | 118/324 |

FOREIGN PATENT DOCUMENTS

| | | | |
|---|---|---|---|
| 282068 | 11/1989 | Japan | 104/89 |
| 361538 | 5/1962 | Switzerland | 104/89 |

*Primary Examiner*—W. Gary Jones
*Assistant Examiner*—Charles K. Friedman
*Attorney, Agent, or Firm*—Fred Philpitt

[57] ABSTRACT

A single-line parts coating system comprises plural coating sections each housing plural coating booths, horizontally-movable nonflexible rails located in the respective coating sections, a first fixed nonflexible rail for introducing parts to be coated into a first coating section, intermediate fixed non-flexible rails located between the coating sections, a last fixed nonflexible rail for discharging the parts from a last coating section, and horizontally-flexible rails located between the nonflexible rails to connect the nonflexible rails. Each flexible rail comprises rail pieces and connecting plates connecting the rail pieces together. The rail pieces are in contact with each other. Each connecting plate is fixed to one of adjacent rail pieces, and is pivotally connected to the other rail piece. Thus, the rail pieces, together with the connecting plates fixed thereto, are capable of horizontal arcing motion relative to adjacent rail pieces. The connecting plates, however, serve to limit the arcing motions to a relatively small range.

9 Claims, 18 Drawing Sheets

SINGLE-LINE PARTS COATING SYSTEM

REFERENCE TO RELATED APPLICATION

The present application is a division of U.S. patent application No. 689,327 filed Apr. 23, 1991 now U.S. Pat. No. 5,150,655.

FIELD OF THE INTENTION

This invention relates to a single-line parts coating system, and more particularly relates to a single-line system for coating parts, such as automobile parts or electrical parts, with paint.

BACKGROUND OF THE INVENTION

In a parts coating system, a conveyor chain from which trolleys are suspended is moved on rails. Works, such as automobile parts or electrical parts, to be coated with paint are suspended from the trolleys. Where works are relatively small and lightweight, the rail has a rectangular vertical cross section or a C-shaped cross section, for example. Where works are relatively large or heavy in weight, an I-shaped or H-shaped rail, for example, is used. A chain with rollers or a universal chain, for example, may be used as the conveyor chain. Where the trolleys must move in a curved path, a curved rail is used.

The rails (including curved rails), the chain and the trolleys thus comprise a single coating line or loop. Coating booths are located along the coating line. In each coating booth, paint of a particular color is provided (e.g., by spraying). Thus, if three coating booths are provided along the coating line, the coating line can coat three different kinds of parts with three different colors or can coat one part with three different colors. In actuality, however, chiefly because of a limitation of linear space, it is impossible or difficult to provide more than 3 or 4 coating booths along one coating line. Thus, if such a large number of coating booths must be used, it is necessary to provide an additional coating line or lines. And where more than one coating line is provided, each coating line is used for a coating with a particular color.

However, it is possible to reduce the necessary number of coating lines by employing a "flexible rail" of the invention which will be hereinafter described in detail. For example, if two coating lines are required to provide six coating booths in the prior art, the "flexible rail" of the invention can be used to reduce the number of coating lines to one while providing the same number of coating booths.

SUMMARY OF THE INTENTION

It is an object of the invention to provide a single-line parts coating system.

Another object of the invention is to provide a single-line parts coating system including horizontally-flexible rails.

According to the invention, a single-line parts coating system may comprise plural coating sections each housing plural coating booths, movable nonflexible rails located in the respective coating sections, a first fixed nonflexible rail for introducing parts to be coated into a first coating section, intermediate fixed nonflexible rails located between the coating sections, a last fixed nonflexible rail for discharging the parts from a last coating section, horizontally-flexible rails located between the nonflexible rails to connect the nonflexible rails, means for suspending the movable nonflexible rail, means for suspending the horizontally-flexible rail, trolleys which run suspended from the nonflexible and flexible rails, and plural operating means each provided in conjunction with one of the coating sections for moving the movable nonflexible rail transversely in a horizontal plane to selectively locate the nonflexible rail in one of the coating booths.

Each flexible rail comprises rail pieces and connecting plates. The rail pieces are in contact with each other. Each intermediate rail piece has a concave front end face and a convex rear end face, and is in contact with adjacent rail pieces at its concave front end face and its convex rear end face, respectively. A foremost rail piece has a straight or flat front end face and a convex rear end face and, is in contact with the adjacent rail piece at its convex rear end face. A rearmost rail piece has a concave front end face and a straight or flat rear end face, and is in contact with the adjacent rail piece at its concave front end face. Each of the connecting plates except the foremost one bridges adjacent rail pieces, and is fixed on the top of the rear one of the adjacent rail pieces. The foremost connecting plate is fixed on the top of the foremost rail piece. Each of the connecting plates except the foremost one is pivotally connected to the front one of the adjacent rail pieces. Thus, each of the connecting plates except the foremost one can move in an arc (in a horizontal plane) together with the rail piece to which the connecting plate is fixed.

According to one aspect of the invention, the connecting plates are slightly spaced apart from each other, and each connecting plate has a trapezoidal front end with a central straight face and inclined side faces and a straight rear end. One of the inclined faces of the rear one of adjacent connecting plates and the straight rear end of the front connecting plate limit the arcing motions of the adjacent rail pieces to a small range.

According to another aspect of the invention, each connecting plate has a ridged front end with inclined faces which from a central ridge and a ridged rear end with inclined faces which form a central ridge, and the connecting plates are in contact with each other at the central ridges thereof.

A rail piece with a desired shape may be used. For example, an I-shaped rail piece may be used. A rail piece with other shape, such as the shape of the letter "C", can also be used.

In addition, according to the invention, a flexible conveyor can be provided which may comprise (i) an integrally-formed central nonflexible rail which is movable in a horizontal plane, (ii) a first integrally-formed outer nonflexible rail which is immovable, (iii) a second integrally-formed outer nonflexible rail which is immovable, (iv) a first horizontally-flexible rail connected between the first outer nonflexible rail and the central nonflexible rail, (v) a second horizontally-flexible rail connected between the central nonflexible rail and the second outer nonflexible rail, (vi) lateral guide rails for suspending the central nonflexible rail, (vii) lateral guide rails for suspending the flexible rail, (viii) trolleys which run suspended from the nonflexible and flexible rails, and (ix) means for moving the central nonflexible rail transversely in a horizontal plane.

DETAILED DESCRIPTION OF PREFERRED EMBODIMENTS

Parts Coating System

Figure 1:
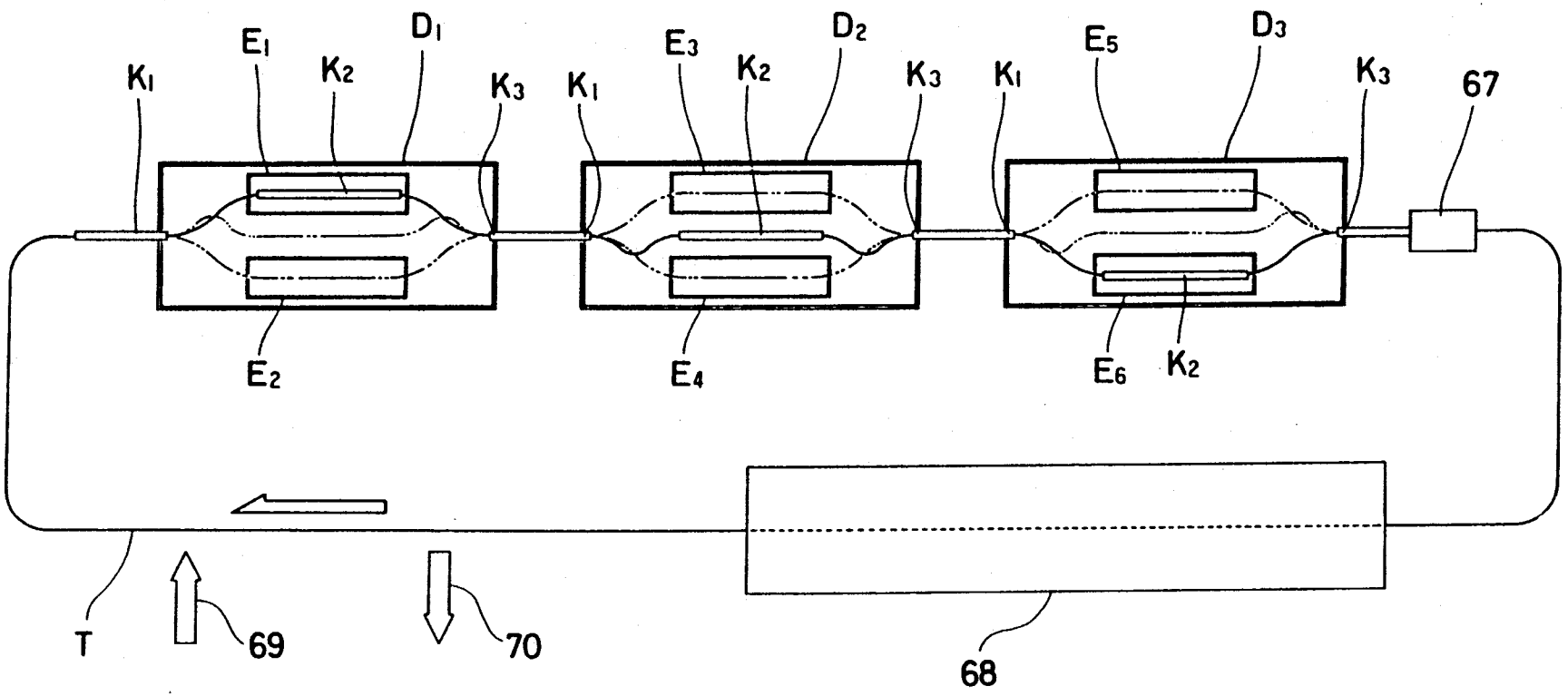
FIG. 1 is a plan view of a single-line parts coating system according to the invention.

Referring to FIG. 1, a single-line parts coating system which embodies the invention in one preferred from will now be described.

The parts coating system of FIG. 1 includes a trolley conveyor T and coating sections $D_1$, $D_2$ and $D_3$ located along the trolley conveyor T. Reference numeral 67 designates means for operating the trolley conveyor T. Reference numeral 68 designates a furnace for drying coated works by baking them. Coating booths $E_1$ and $E_2$ are located in the coating section $D_1$; coating booths $E_3$ and $E_4$, in the coating section $D_2$; and coating booths $E_5$ and $E_6$ in the coating section $D_3$.

A nonflexible rail $K_2$ is located in each coating section. The nonflexible rail $K_2$ is horizontally movable in the lateral direction of the coating section.

A nonflexible rail $K_1$ is located on the upstream side of the coating section $D_1$. Another nonflexible rail is located between the coating sections $D_1$ and $D_2$ (this rail is designated by both reference numerals $K_3$ and $K_1$). Another nonflexible rail is located between the coating sections $D_2$ and $D_3$ (this rail is also designated by both reference numerals $K_3$ and $K_1$). Another nonflexible rail $K_3$ is located on the downstream side of the coating section $D_3$. All these nonflexible rails located outside the coating sections are immovable.

As illustrated, all the nonflexible rails $K_1$, $K_2$ and $K_3$ are connected to each other by horizontally-flexible rails.

Each coating booth ($E_1$ to $E_6$) may be provided with devices, such as sprays, for coating works with paint of a particular color. Thus, the parts coating system of FIG. 1 can coat works with 6 different colors.

Operation of the Parts Coating System

In use, works, such as automobile parts or electric parts, to be painted with particular colors are loaded on the trolley conveyor T at, for example, 69. Then, the trolley conveyor T is moved. When the works have entered the coating section housing the appropriate coating booth, i.e., the coating booth where the paint of a particular color with which to coat the works is provided, the conveyor T is stopped. Then, the nonflexible rail $K_2$ is moved into the appropriate coating booth.

Alternatively, immediately before the works enter the coating section, the conveyor T is stopped. Then, the nonflexible rail $K_2$ is moved into the appropriate coating booth. Then, the conveyor T is restarted to move the works into the appropriate coating booth, and then is stopped.

Then, the works are coated in the coating booth. Then, the nonflexible rail $K_2$ is returned to the middle position, and the works are conveyed to the drying furnace 68. (Alternatively, the works can be conveyed to the drying furnace 68 without returning the nonflexible rail $k_2$ to the middle position.) Then, the works are unloaded at 70.

Flexible Conveyor Line

Figure 2:
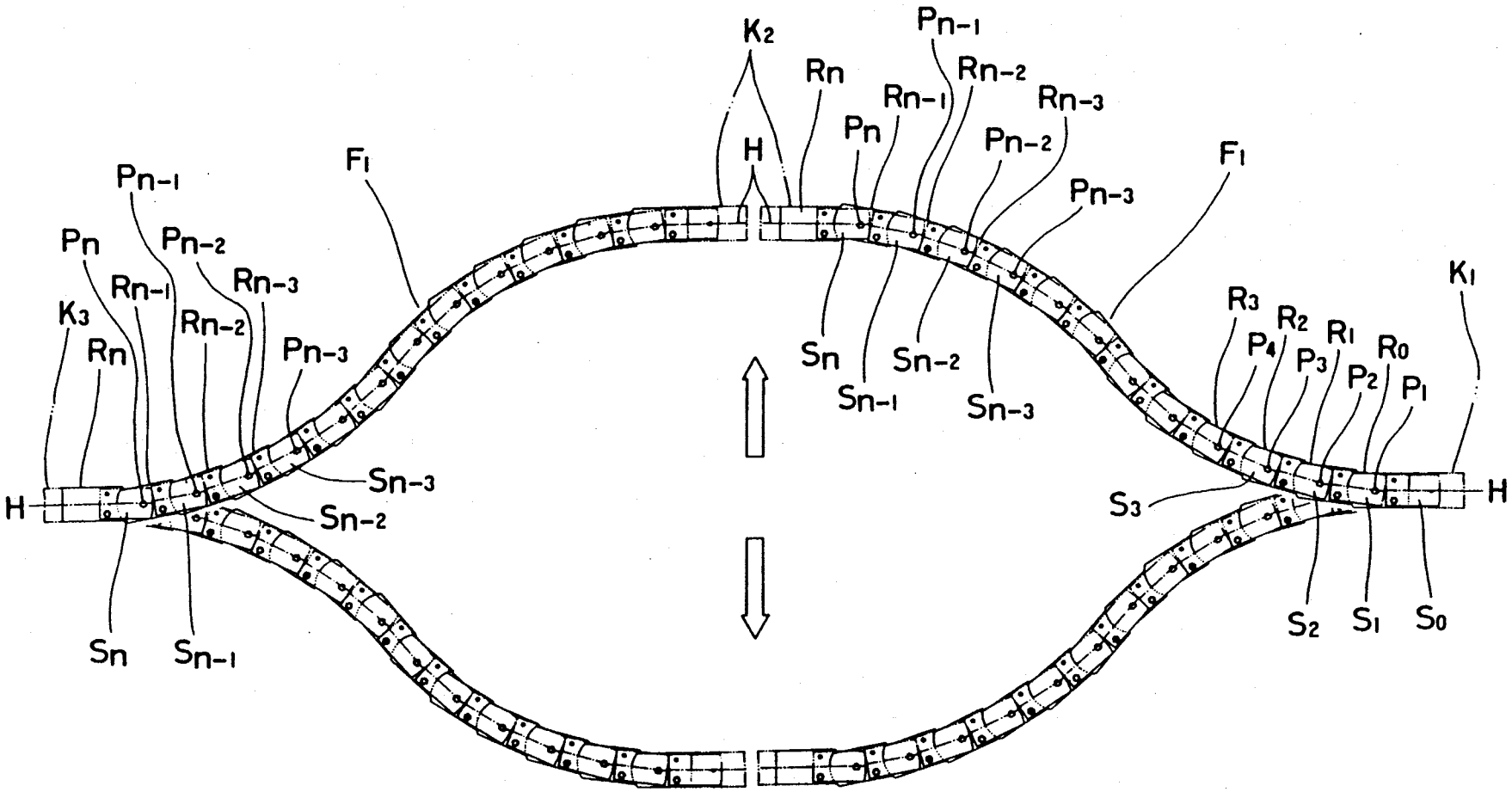
FIG. 2 is a plan view of a flexible conveyor line used in the parts coating system of FIG. 1.

A major component of the parts coating system of FIG. 1, namely, the flexible rails and the nonflexible rails $K_1$, $K_2$, and $K_3$, is illustrated in detail in FIG. 2.

In FIG. 2 the flexible rails are designated by reference numeral $F_1$.

Referring to FIG. 2, one flexible rail $F_1$ has one end connected to the right end of the central nonflexible rail $K_2$ and an opposed end connected to one outer nonflexible rail $K_1$, while the other flexible rail $F_1$ has one end connected to the left end of the central nonflexible rail $K_2$ and an opposed end connected to the other outer nonflexible rail $K_3$. Each nonflexible rail ($K_1$, $K_2$, and $K_3$) is an integrally-formed rail. As described above, the central nonflexible rail $K_2$ is movable in a horizontal plane, while the outer nonflexible rails $K_1$ and $K_3$ are immovable. Thus, when the central rail $K_2$ is moved (as indicated by arrows), the flexible rails $F_1$ flex.

The flexible rails Fl and nonflexible rails $K_1$, $K_2$, and $K_3$ thus constitute a horizontally-flexible conveyor line.

Each nonflexible rail ($K_1$, $K_2$, and $K_3$) may be an I-shaped rail.

Figure 3:
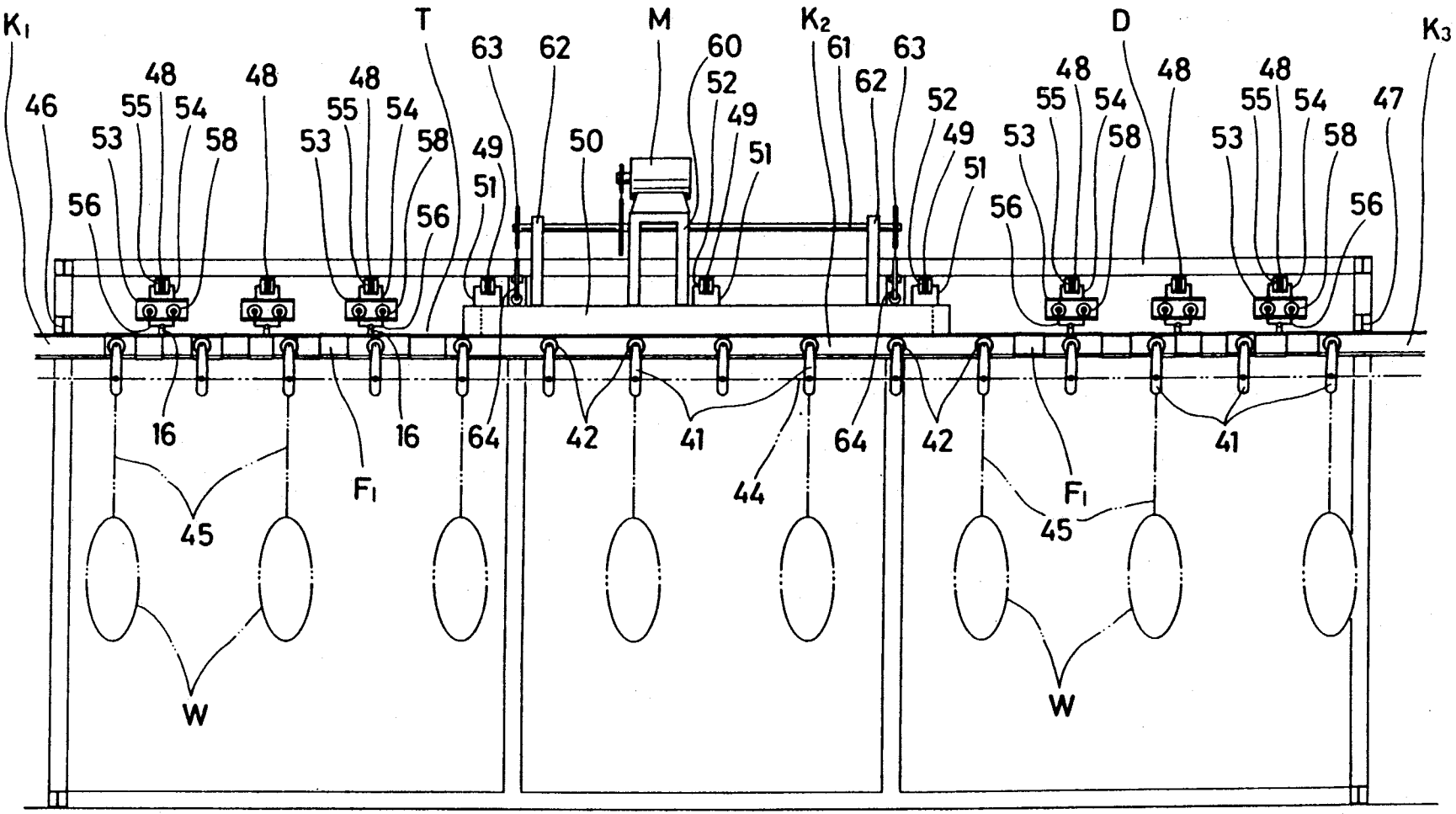
FIG. 3 is an elevational view of part of the parts coating system of FIG. 1.
Figure 4:
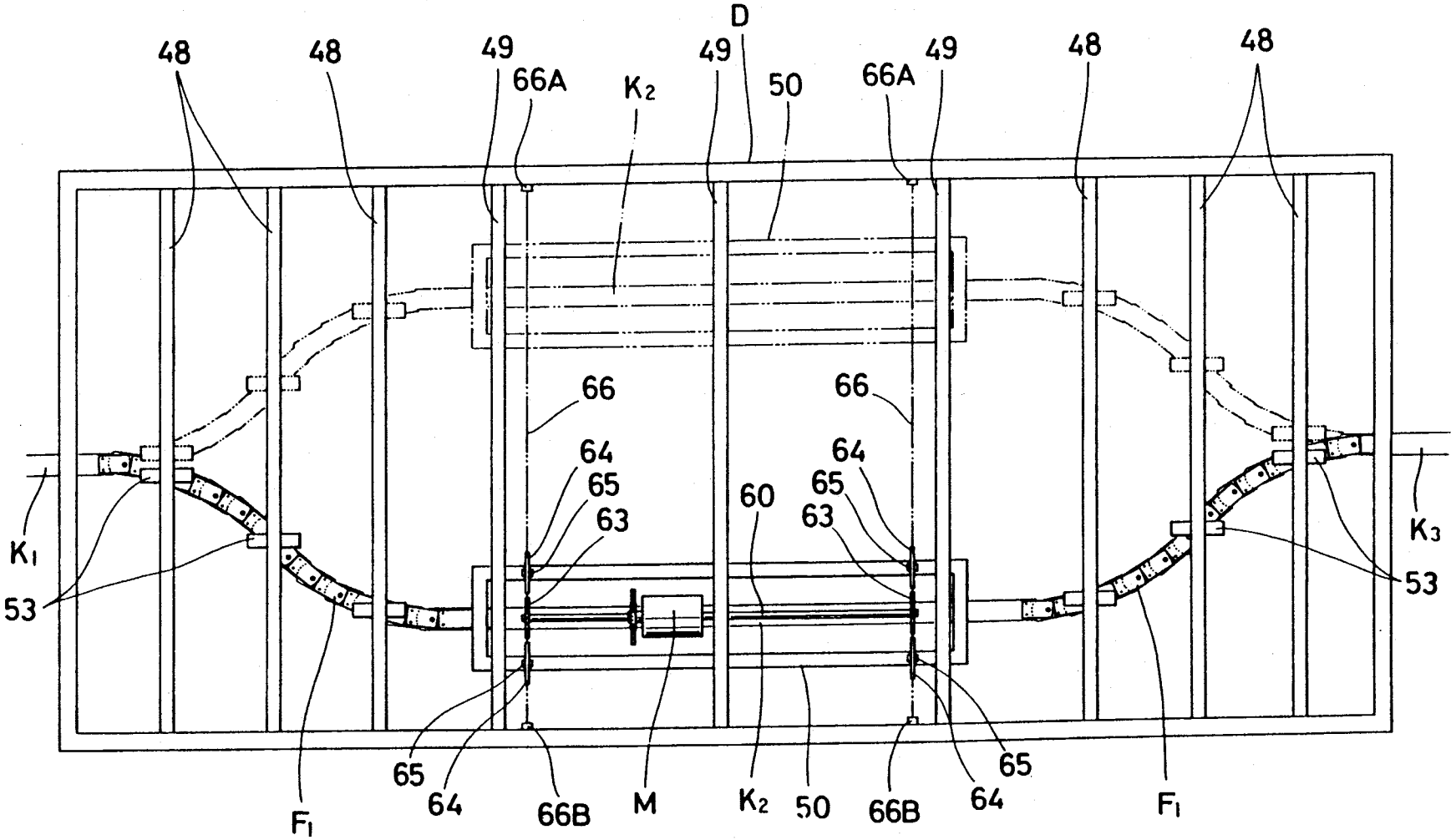
FIG. 4 is a plan view of the part of FIG. 3.
Figure 7:
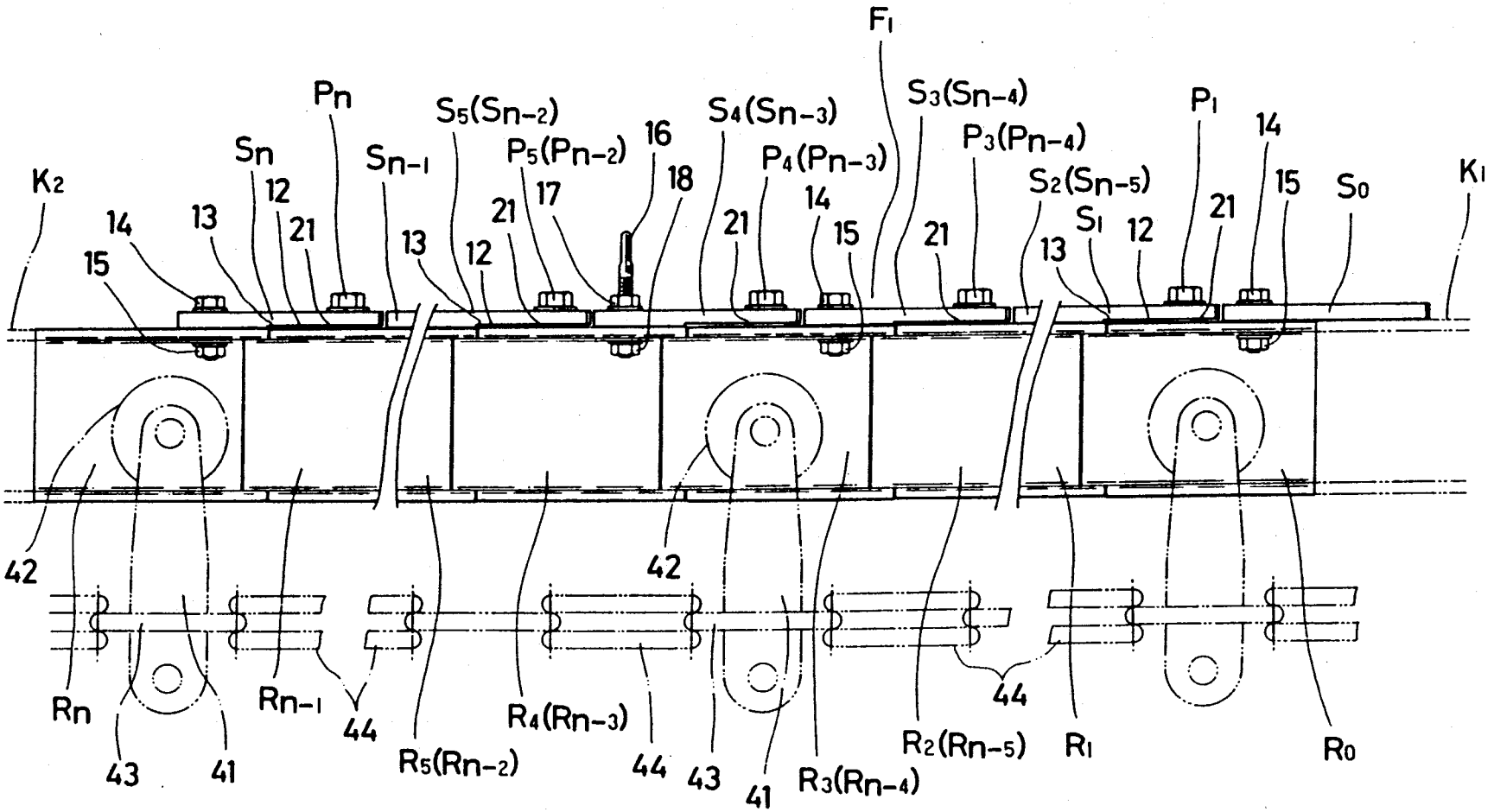
FIG. 7 is a side view of the flexible rail of FIG. 5.
Figure 9:
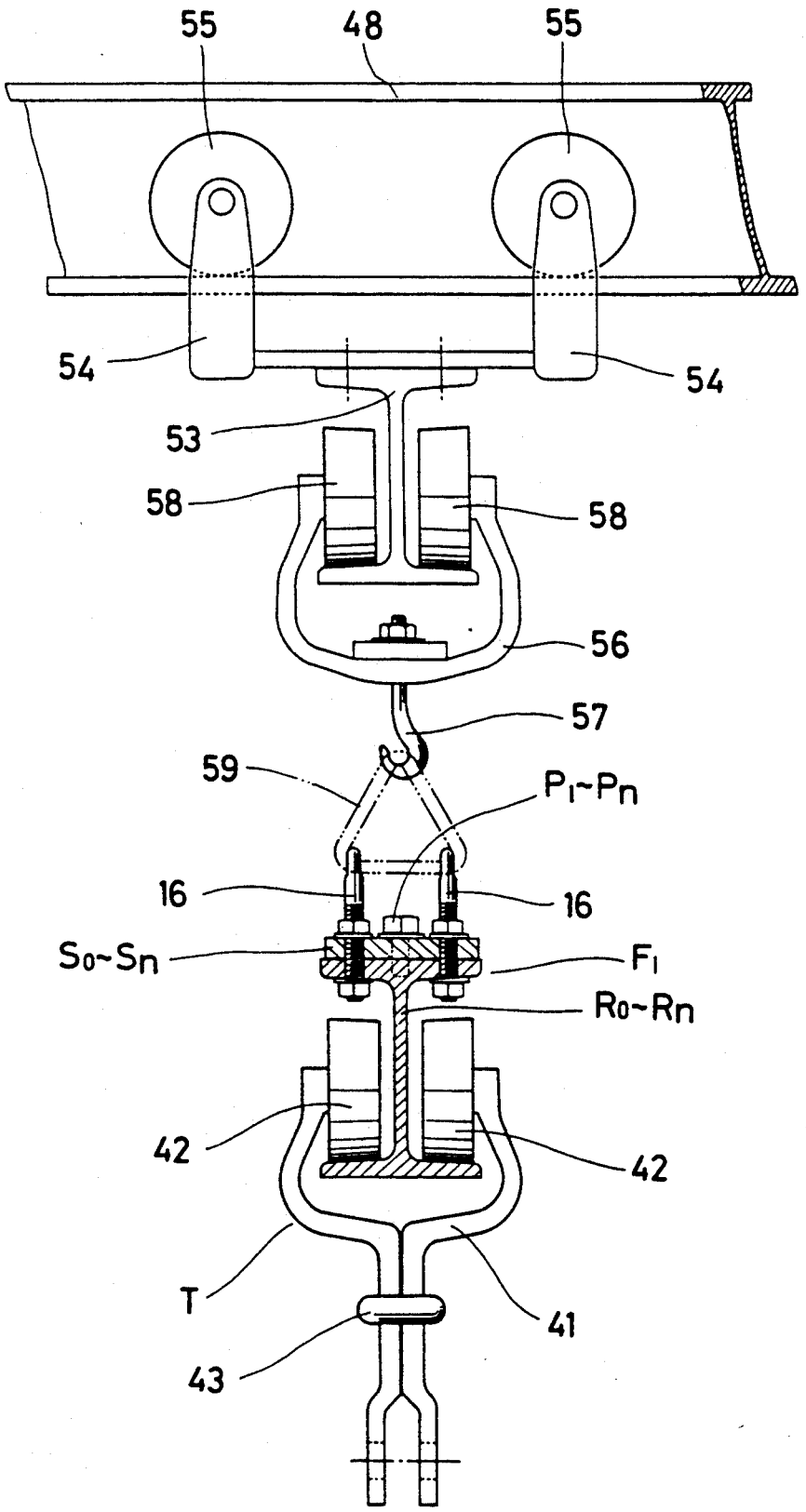
In FIG. 9 the flexible rail of FIG. 5 is suspended from a short rail member which is in turn suspended from a lateral rail.

FIGS. 3 and 4 is a detailed view of part of the parts coating system of FIG. 1. FIGS. 3 and 4 must be viewed in conjunction with FIGS. 7 and 9 since details not illustrated in FIGS. 3 and 4 are illustrated in FIGS. 7 and 9.

In FIGS. 3 and 4 the letter D designates a framework.

As illustrated in FIG. 4, the central nonflexible rail $K_2$ is movable in a lateral direction of the framework D.

The rail $k_1$, located on a side of supply of works, is fixed to a left-hand lateral I-shaped rail 46. The rail $k_3$, located on a side of discharge of works, is fixed to a right-hand lateral I-shaped rail 47.

Each flexible rail $F_1$ is suspended from lateral I-shaped rails 48 fixed to the top of the framework D. That is, a trolley 54 is carried on the rail 48 with guide rollers 55 (of the trolley 54) supported on the bottom of the rail 48. An I-shaped rail member 53 is fixed to the lower end of the trolley 54. A trolley 56 is in turn carried on the rail member 53 with guide rollers 58 (of the trolley 56) supported on the bottom of the rail member 53. A hook 57 is rotatably connected to the lower end of the trolley 56 (FIG. 9). A suspending means 59 is suspended from the lower end of the hook 57 (FIG. 9). The bolts 16 of the flexible rail $F_1$ is in turn suspended from the suspending means 59.

Lateral I-shaped rails 49 are located between the left-hand lateral rails 48 and the right-hand lateral rails 48. The central lateral rails 49 are also fixed to the top of the framework D. Trolleys 51 are carried on the central lateral rails 49 with guide rollers 52 (of the trolleys 51) supported on the bottoms of the central lateral rails 49. A rectangular frame 50 is in turn suspended from the trolleys 51. The central movable longitudinal rail $K_2$ is fixed to the bottom of the frame 50.

Trolleys 41 are moved along the rails $K_1$, $F_1$, $K_2$, $F_1$ and $K_3$, with guide rollers 42 (of the trolleys 41) supported on the bottoms of the rails.

In FIGS. 7 and 9 reference numeral 43 designates brackets which connect link chains 44. A hanger 45 is suspended from the trolley 41. A work W is in turn suspended from the hanger 45.

A motor support 60 is mounted on the frame 50. A motor M in turn mounted on the motor support 60. A driving shaft 61 is operatively connected to the motor M. The driving shaft 61 is supported on bearings 62. Driving sprockets 63 are connected to the ends of the driving shaft 61, respectively. Two guide sprockets 64 are located with each driving sprocket 63 between (as viewed from above). The guide sprockets 64 are supported on bearings 65. A chain 66 is fitted on the driving sprocket 63 and the guide sprockets 64. One end 66A of the chain 66 is fixed to one side of the top of the framework D, while the other end 66B of the chain 66 is fixed to the opposed side of the top of the framework D.

In use, the motor M is operated. Thereupon, the driving shaft 61 and, hence, the driving sprockets 63 are rotated, so that the frame 50 and, hence, the central nonflexible rail $k_2$ are moved toward one side of the framework D. This movement is guided by the guide rollers 52 rolling on the lateral rails 49. When the central nonflexible rail $K_2$ is thus moved, the flexible rails $F_1$ flex concomitantly (FIG. 4). The flexure of the flexible rail $F_1$ is guided by the guide rollers 55 rolling on the lateral rail 48.

When the flexible rail $F_1$ thus flexes, its rail pieces slightly move in a longitudinal direction, or in the direction in which the works W are conveyed. The guide rollers 58 allow for this longitudinal movement. That is, when the rail pieces thus move, the guide rollers 58 roll on the I-shaped member 53.

Flexible Rail

The flexible rail $F_1$ will now be described in detail with reference to FIGS. 5 to 12.

Figure 5:
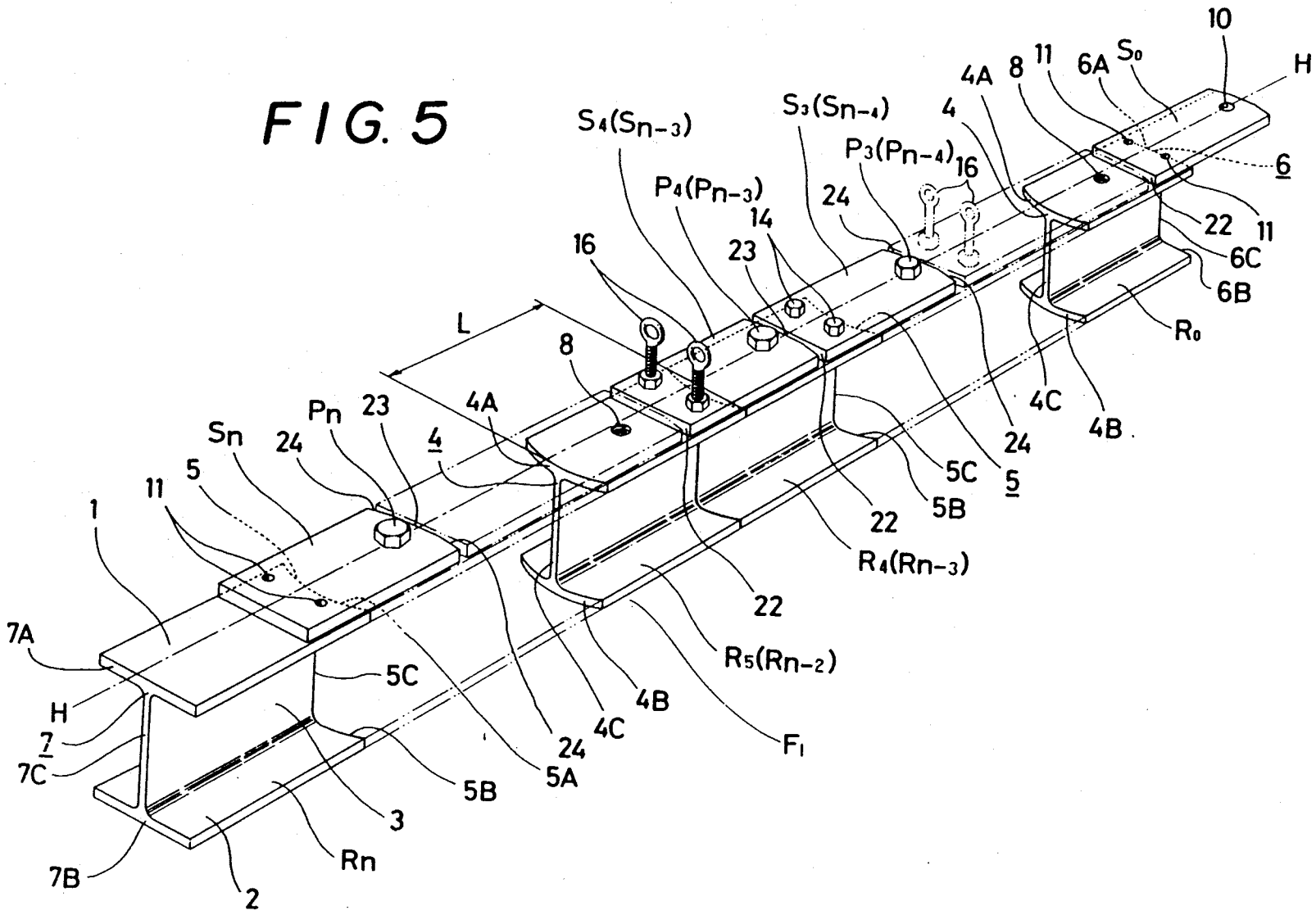
FIG. 5 is a perspective view of a flexible rail.
Figure 6:
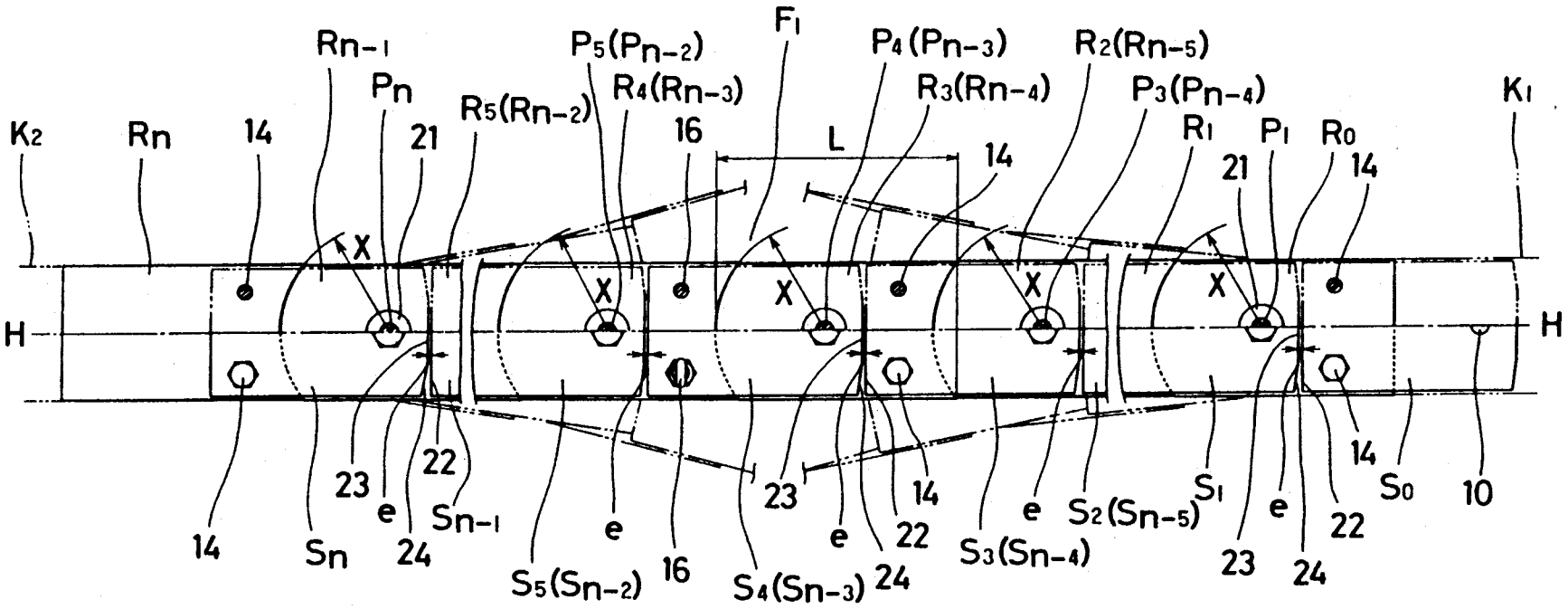
FIG. 6 is a plan view of the flexible rail of FIG. 5.

As shown in FIGS. 5, 6, and 7 in particular, the flexible rail $F_1$ comprises generally I-shaped rail pieces $R_0$ to $R_n$ and horizontal connecting plates $S_1$ to $S_n$.

All the rail pieces except the extreme ones $R_0$ and $R_n$, namely the intermediate rail pieces $R_1$ to $R_{n-1}$, have identical shapes.

Figure 10:
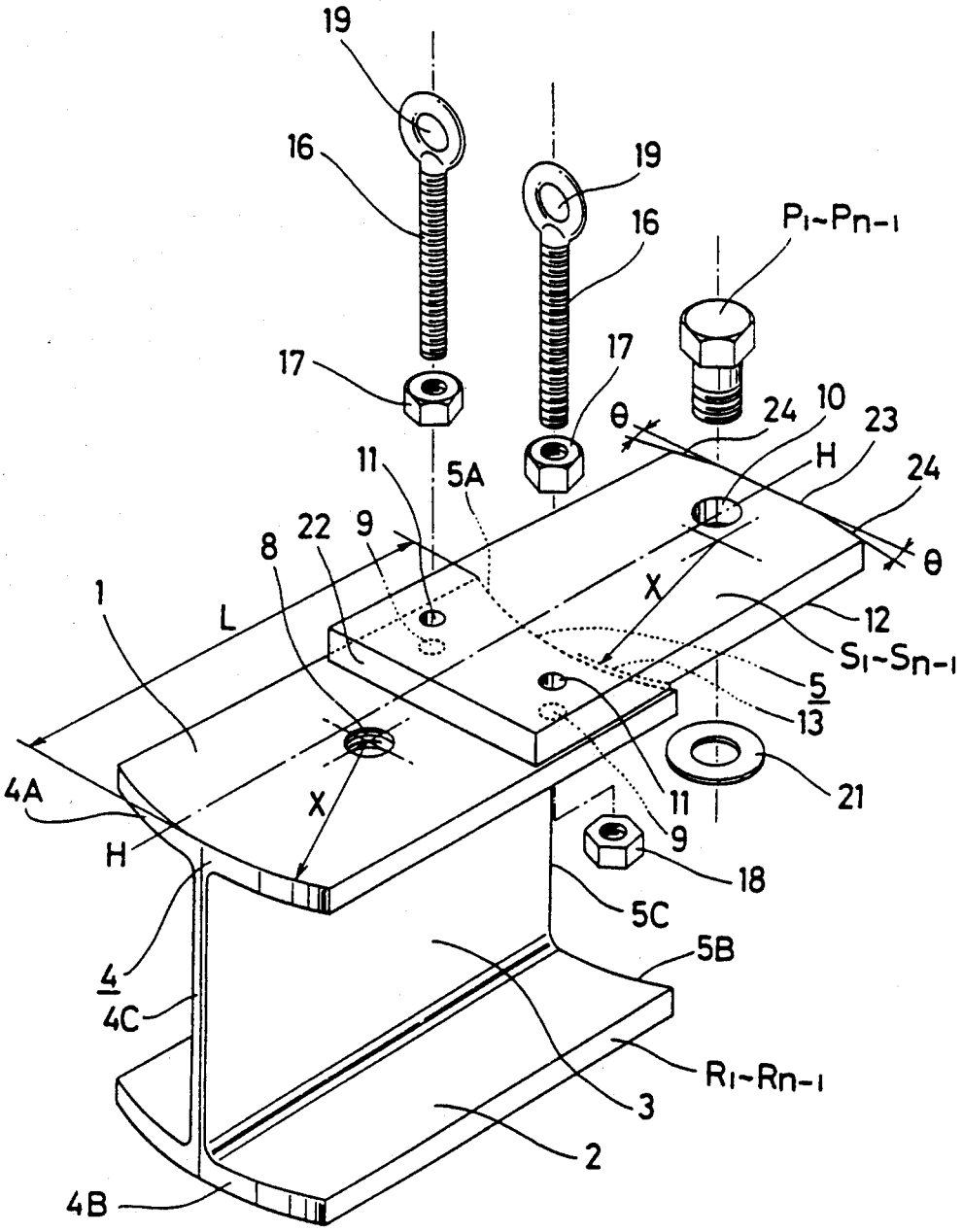
FIG. 10 shows an intermediate rail piece and a connecting plate fixed thereto.

FIG. 10 depicts one of the intermediate rail pieces. As depicted, the intermediate rail piece generally has the shape of the letter "I", and has a concave front end face 5 and a convex rear end face 4.

Figure 11:
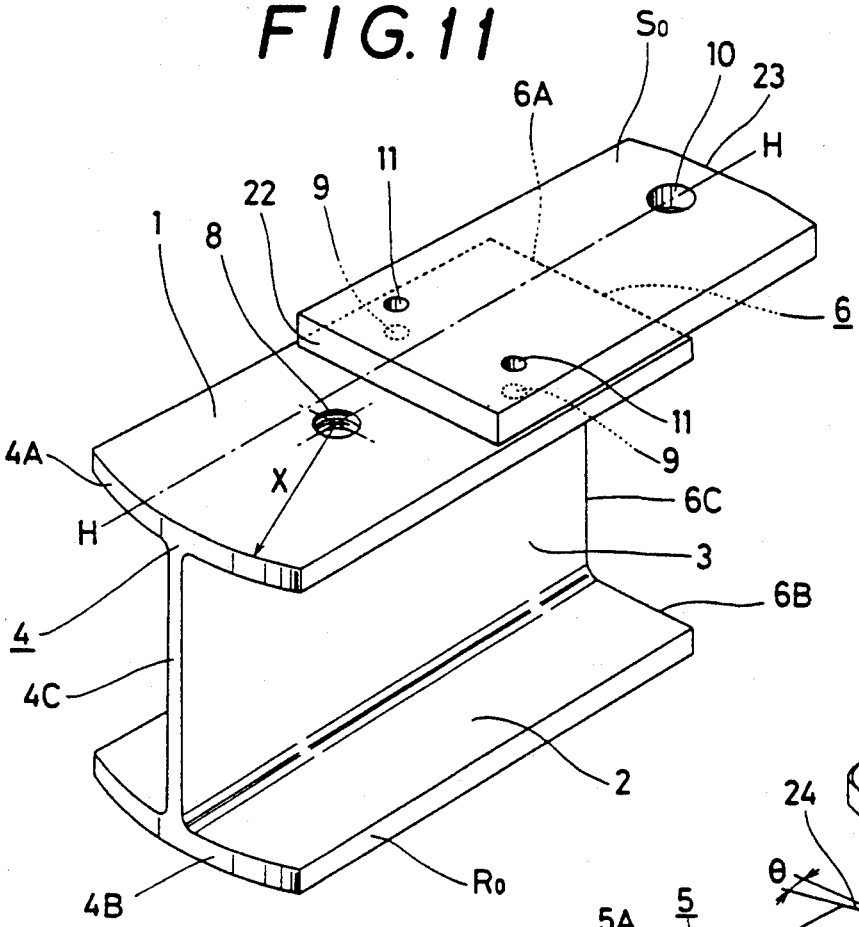
FIG. 11 shows a foremost rail piece and a connecting plate fixed thereto.

FIG. 11 depicts one of the extreme rail pieces, namely, a foremost rail piece $R_0$. As depicted, the foremost rail piece has a shape identical to that of the intermediate piece except that the foremost rail piece has a flat or straight front end face 6.

Figure 12:
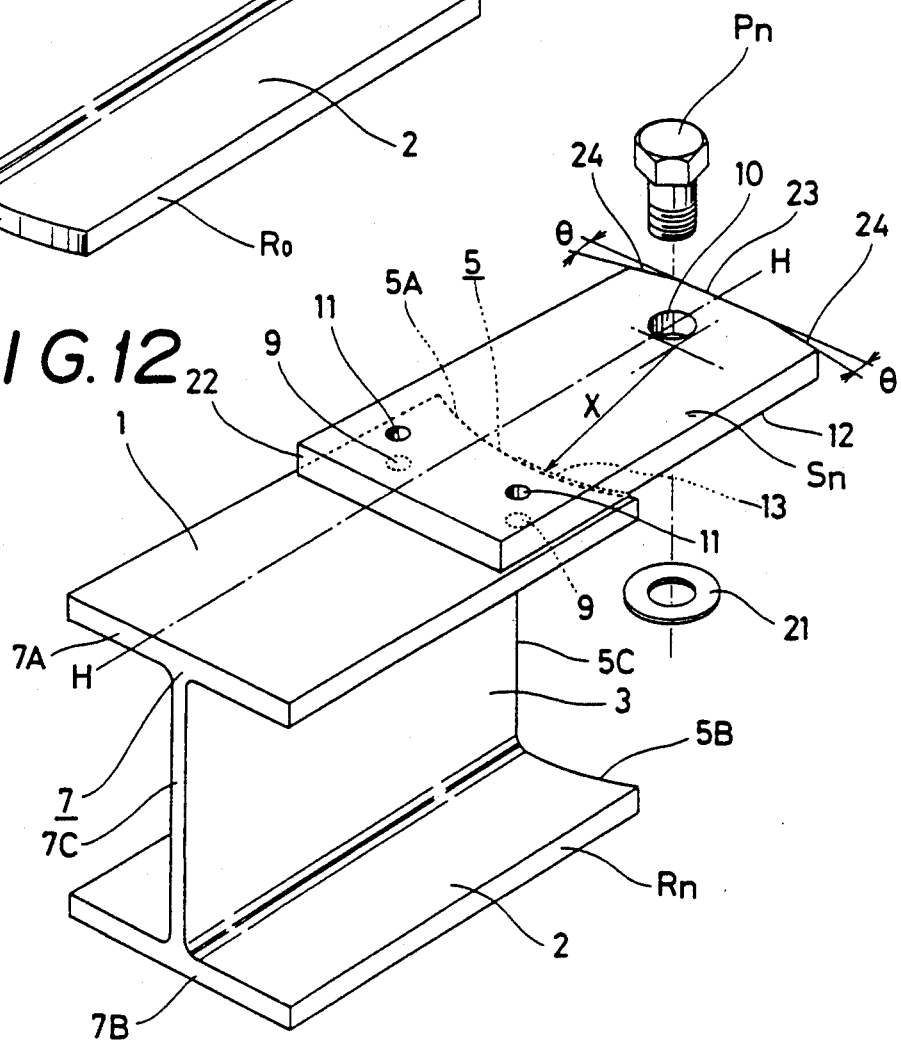
FIG. 12 shows a rearmost rail piece and a connecting plate fixed thereto.

FIG. 12 depicts the other extreme rail piece, namely, a rearmost rail piece $R_n$. As depicted, the rearmost rail piece has a shape identical to that of the intermediate rail piece except that the rearmost rail piece has a flat or straight rear end face 7.

Figure 8:
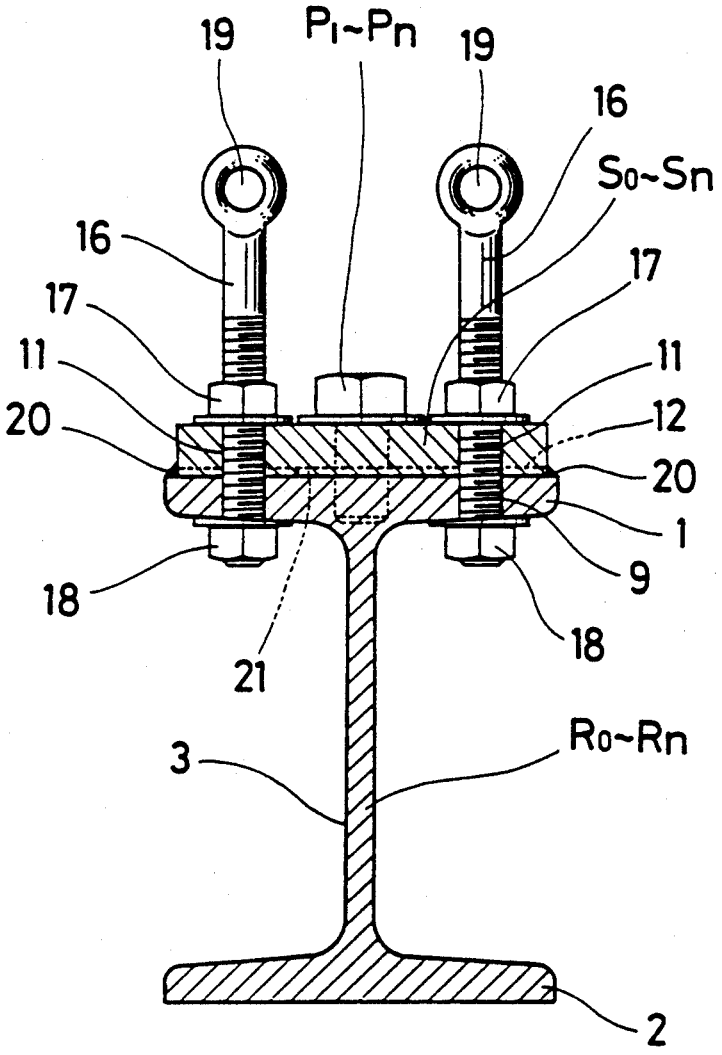
FIG. 8 shows a rail piece used in the flexible rail of FIG. 5.

In FIG. 8, reference numeral 1 designates a horizontal top portion of the rail piece ($R_0$ to $R_n$); reference numeral 3, a vertical intermediate portion thereof; and reference numeral 2, a horizontal bottom portion thereof.

In FIG. 10, reference numeral 4A designates a top portion of the convex rear end face 4; reference numeral 4C, a vertical portion thereof; and reference numeral 4B, a bottom portion thereof. Also, in FIG. 10, reference numeral 5A designates a top portion of the convex front end face 5; reference numeral 5C, a vertical portion thereof; and reference numeral 5B, a bottom portion thereof.

The rail pieces are connected together by horizontal connecting plates $S_1$ to $S_n$.

The connecting plate $S_1$ connects the first rail piece $R_0$ (foremost rail piece) and the second rail piece $R_1$. The connecting plate $S_n$ connects the last rail piece $R_n$ (rearmost rail piece) and the rail piece located immediately in front of the last rail piece $R_n$.

Figure 16:
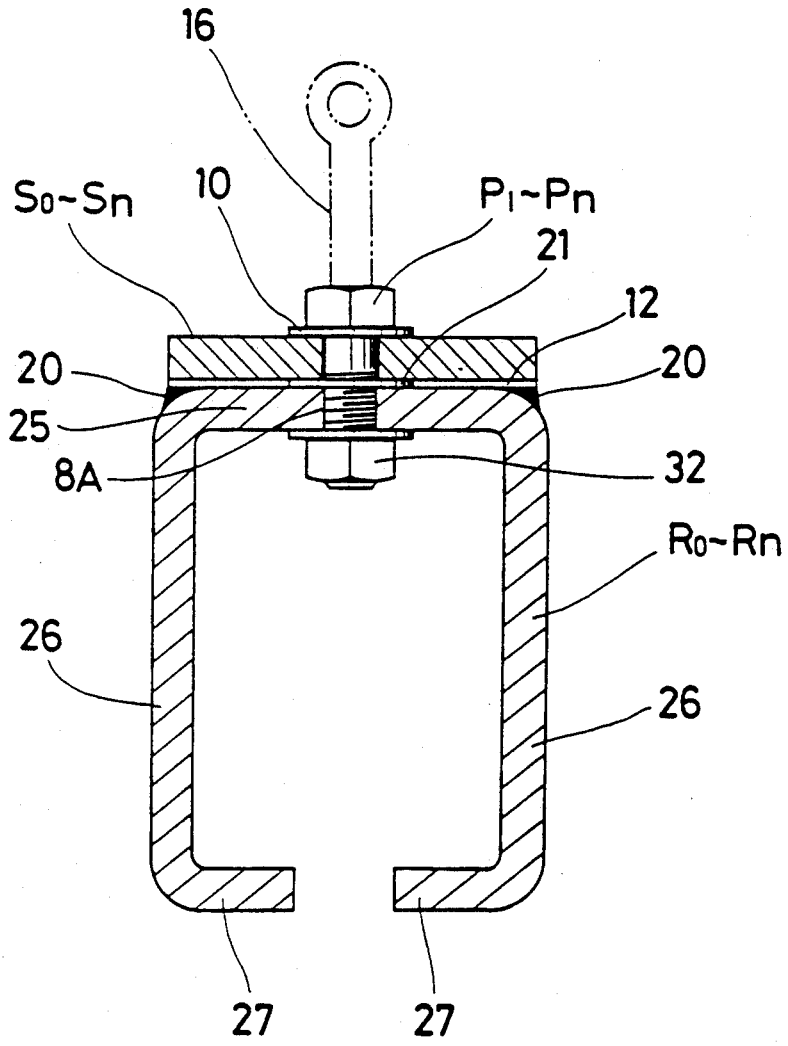
FIG. 16 is a front view of the rail piece and the connecting plate of FIG. 14.

Each of the connecting plates ($S_1$ to $S_n$) except the foremost one $S_0$ bridges adjacent rail pieces, and is fixed to the rear one of the adjacent rail pieces (FIG. 16).

Each connecting plate is provided with a pair of opposed rear openings 11, and the top portion 1 of each rail piece is provided with opposed front openings 9 which are vertically aligned with the respective rear openings 11 of the connecting plate. Bolts 14 and nuts 15 may be used to fix the connecting plate to the rail piece. That is, the bolts 14 may be inserted into the openings 11 and 19 and received by the nuts 15 (FIG. 7). However, not all the connecting plates are fixed to the rail pieces in such a manner. That is, it is necessary to fix some of the connecting plates to the rail pieces by means of long bolts 16 (FIGS. 5, 7, 8, and 10). As clearly shown in FIG. 10, the long bolts 16 are also inserted into the openings 11 and 9. An upper nut 17 and a lower nut 18 are used in conjunction with the long bolt 16.

The reason for the necessity to fix some of the connecting plates in such a manner is that it is necessary to suspend the flexible rail $F_1$ in use. For this purpose, the top of the long bolt 16 has an opening 19 (FIGS. 8 and 10). If desired, however, the top of the long bolt 16 may be made into the shape of a hook for the same purpose (not shown).

All the connecting plates except the foremost one $S_0$ have identical shapes. That is, each connecting plate ($S_1$ to $S_n$) has a central straight face 23 and inclined side faces 24, 24 at its front end, and has a straight rear end 22 (FIGS. 10 and 12). Also, the bottom of each connecting plate ($S_1$ to $S_n$) has a recess 12 with a curved rear face 13 (FIGS. 7, 10, and 12). The rear curved face 13 corresponds to the concave front end face 5 of the rail piece. To be more exact, the curved rear face 13 is vertically aligned with the concave front end face 5 of the rail piece.

The foremost connecting plate $S_0$ has exactly the same shape as each of the other connecting plates ($S_1$ to $S_n$) except that the foremost connecting plate $S_0$ has no recess at its bottom (FIGS. 7 and 11).

Each connecting plate has a front central opening 10 (FIGS. 5, 10, 11, and 12). Each of the rail pieces except the rearmost one Rn has a threaded opening 8 which is vertically aligned with the front central opening 10 (FIGS. 10 and 11). The opening 8 is located at a substantial middle of the length direction of the top 1 of the rail piece. A bolt ($P_1$ to $P_n$) is screwed into the openings 10 and 8. The bolt has a thread at its lower portion, and the thread of the bolt is engaged with the thread of the opening 8. Thus, the bolt is fixed to the rail piece. Hence the bolt serves to connect adjacent rail pieces together.

For example, a bolt $P_1$ (FIGS. 6 and 7) serves to connect the first rail piece $R_0$ (foremost rail piece) and the second rail piece $R_1$ together. Similarly, a bolt $P_3$ serves to connect the rail pieces $R_2$ and $R_3$ together. A rearmost bolt Pn serves to connect the last two rail pieces $R_n$ and $R_{n-1}$ together.

However, the bolt ($P_1$ to $P_n$) is not fixed to the connecting plate, but the bolt is rotatable in the opening 10 of the connecting plate. To be exact, the bolt and the rail piece (to which the bolt is fixed), as one body, are capable of arcing motion relative to the connecting plate in a horizontal plane. To be more exact, each of adjacent rail pieces, together with the connecting plate fixed thereto, is capable of horizontal arcing motion relative to the other rail piece.

Thus, each bolt ($P_1$ to $P_n$) may be called a "pivotal bolt".

Adjacent rail pieces are in contact with each other. That is, the concave front end face 5 of the rear one of adjacent rail pieces is in contact with the convex rear end face 4 of the front rail piece.

As shown in FIG. 6, adjacent connecting plates are not in contact with each other, but have a small space e between them. To be exact, the straight rear end 22 of the front one of adjacent connecting plates is spaced apart for the small distance e from the central straight face 23 of the front end of the rear connecting plate.

Each of the side faces 24 of the front end of the connecting plate is inclined at an angle of 4 or 5 degrees (FIG. 10). This angle is designated by the letter 8 .

As described above, the rail piece and the connecting plate fixed thereto, as one body, are capable of arcing motion in a horizontal plane and, hence, constitute an "arcing unit". Shortly after starting to arc, however, the rear arcing unit is stopped by the front arcing unit, since one of the inclined side faces 24 of the connecting plate of the rear arcing unit engages with the straight rear end 22 of the connecting plate of the front arcing unit. In other words, the connecting plates of the arcing units limit the arcing motions thereof to small ranges by engaging with each other.

In FIGS. 5 and 6 the line H—H is a longitudinal centerline of the flexible rail Fl. The centerline H—H connects the centers of the threaded openings 8 of the rail pieces. As described later, the pivotal bolt ($P_1$ to $P_n$) is inserted into the openings 10 and 8. As may be understood from FIG. 6, the convex rear end face 4 of the foremost rail piece $R_0$ coincides with a curved line produced by drawing a circle with the radius X round the center of the threaded opening 8 into which the pivotal bolt $P_1$ is screwed. The concave front end face 5 of the second rail piece $R_1$ also coincides with the above-mentioned curved line. Similarly, although not shown, the convex rear end face 4 of the second rail piece $R_1$, as well as the concave front end face 5 of the third rail piece $R_2$, coincides with a curved line produced by drawing a circle with the radius X round the center of the opening 8 into which the pivotal bolt $P_2$ is screwed Also, the convex rear end face 4 of the rail piece $R_{n-1}$, as well as the concave front end face 5 of the rearmost rail piece $R_n$, coincides with a curved line produced by drawing a circle with the radius X round the center of the opening 8 into which the pivotal bolt $P_n$ is screwed.

In short, the convex rear end face 4 of the front one of adjacent rail pieces and the concave front end face 5 of the rear rail piece coincide with a curved line produced by drawing a circle with the radius X round the center of the threaded opening 8 into which the pivotal bolt connecting the adjacent rail pieces is screwed.

The foremost rail piece $R_0$ may be connected to a nonflexible rail $K_1$ at its flat front end face 6 (FIGS. 6 and 11). Similarly, the rearmost rail piece Rn may be connected to a nonflexible rail $K_2$ at its flat rear end face 7 (FIGS. 6 and 12).

As shown in FIG. 7, a washer 21 is disposed in the bottom recess of each connecting plate ($S_1$ to $S_n$). That is, the washer 21 is located between the opening 10 of the connecting plate and the threaded opening 8 of the rail piece. The pivotal bolt is inserted through the washer 21 into the threaded opening 8.

As described before, some of the connecting plates are fixed to the rail pieces by means of the long bolts 16 (FIGS. 5, 7, 8, and 10). As indicated by reference numeral 20 of FIG. 8, it may be desirable that the connecting plate fixed to the rail piece by the long bolts 16 be welded to the rail piece for firmer fixation.

In use the flexible rail $F_1$ may be suspended as shown in FIG. 9. In FIG. 9 a trolley T is carried on the flexible rail $R_1$. Reference numeral 42 designates guide rollers of the trolley T which rest on the bottom of the flexible rail $F_1$.

The flexible rail $F_1$ can be effectively used for conveyance of relatively large or heavy objects.

Figure 13:
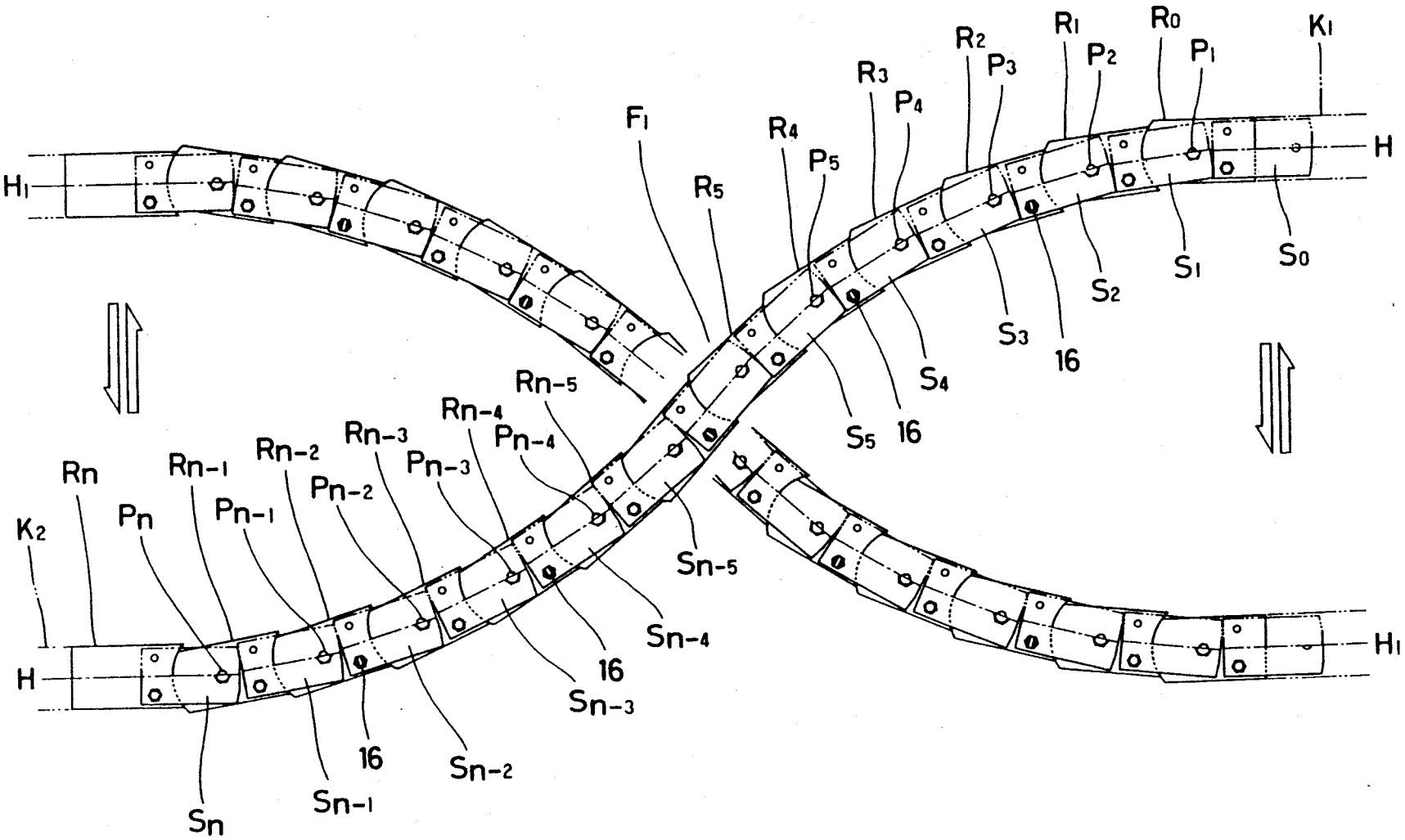
FIG. 13 is a plan view of the flexible rail of FIG. 5 which shows how the rail flexes.

As described before and as shown in FIG. 13, the foremost rail piece $R_0$ and the rearmost rail piece $R_n$ may be connected (fixed) to nonflexible rails $K_1$ and $K_2$, respectively. FIG. 13 shows two possible flexures of the flexible rail $F_1$. In FIG. 13 the nonflexible rail $K_1$ or $K_2$ is moved in a horizontal plane while the other nonflexible rail ($K_1$ or $K_2$) is fixed. As shown, when the nonflexible rail ($K_1$ or $K_2$) is moved, the flexible rail $F_1$ flexes, or makes a wavy motion, in a horizontal plane.

In FIG. 13, each of the rail pieces nearer to the nonflexible rail $K_1$ or $K_2$ (except the foremost and rearmost rail pieces $R_0$ and $R_n$) is stopped shortly after starting to arc, since the adjacent connecting plates engage with each other at one of the inclined side faces 24 (of one of the adjacent connecting plates) and the straight rear end 22 (of the other connecting plate). In FIG. 13, however, the central connecting plates are not in contact with each other, but is slightly spaced from each other and, hence, the central rail pieces move in smaller arcs than the rail pieces nearer to the nonflexible rails.

Second Flexible Rail

Figure 14:
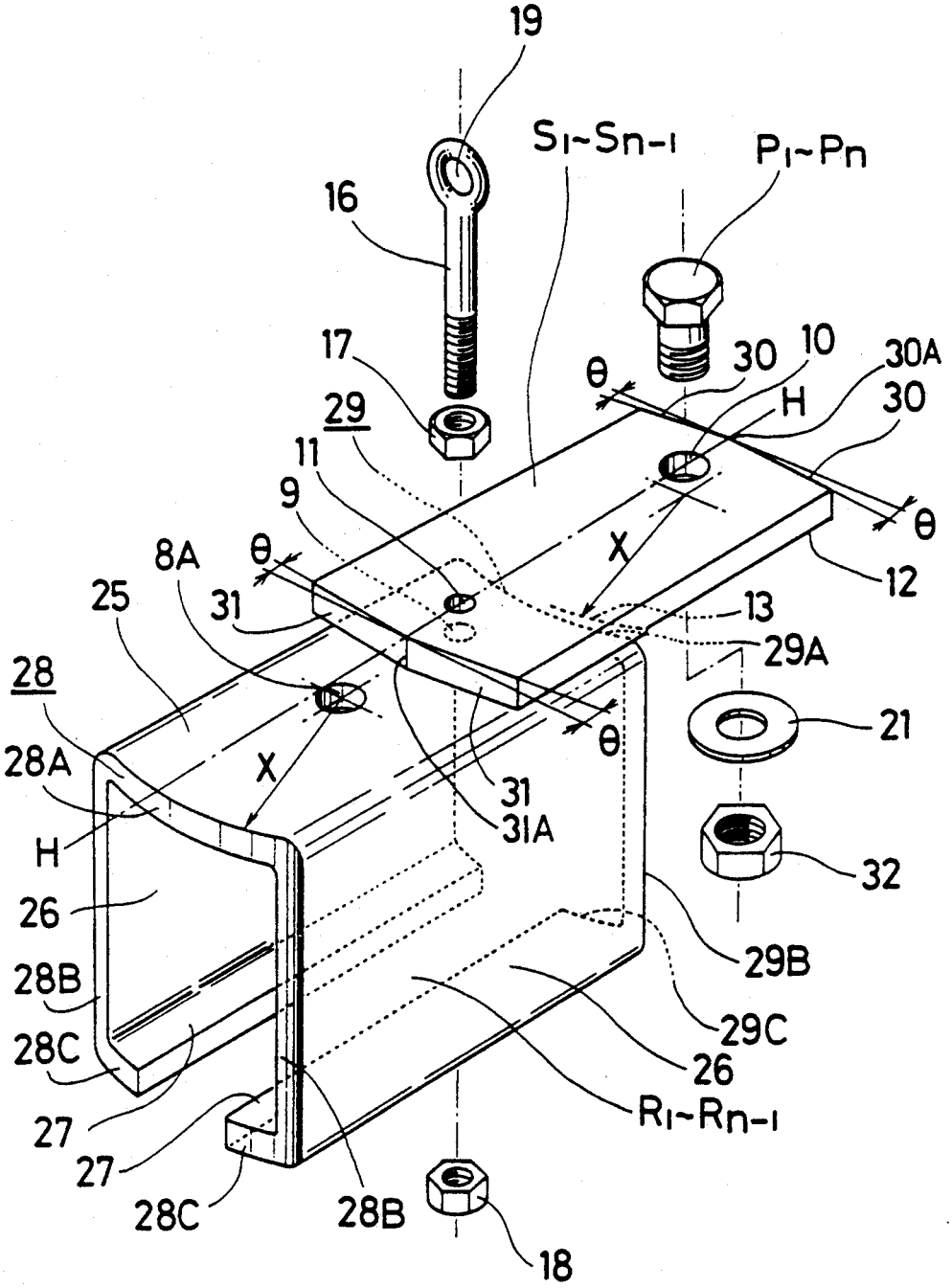
FIG. 14 shows a rail piece and a connecting plate which may be used instead of the rail piece and the connecting plate used for the flexible rail of FIG. 5.
Figure 15:
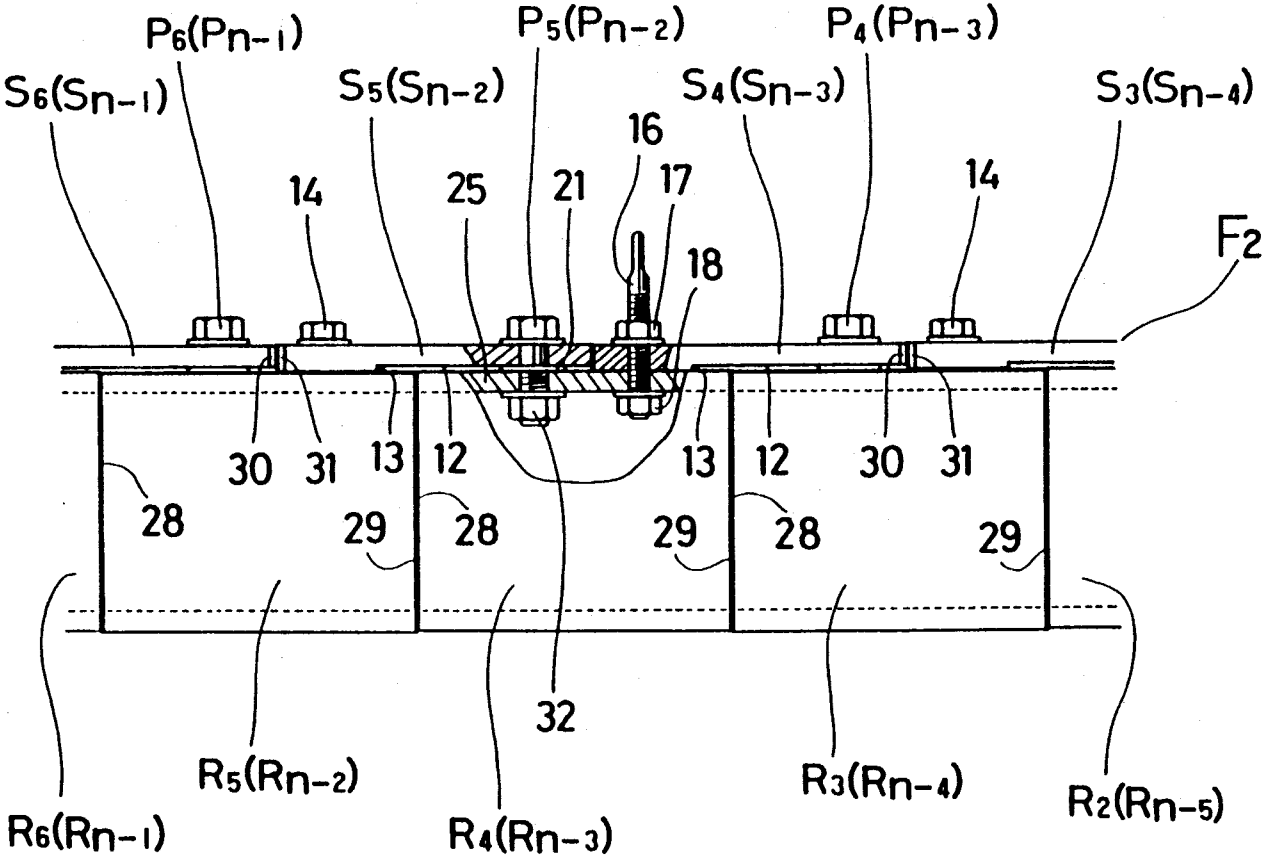
FIG. 15 shows a flexible rail constructed by using the flexible rail and the connecting plate of FIG. 14.

If desired, a flexible rail $F_2$ of FIGS. 14 to 16 may be used instead of the flexible rail $F_1$ to construct a flexible conveyor line.

In FIGS. 14, 15, and 16, parts of the flexible rail $F_2$ similar to those of the flexible rail $F_1$ are designated by the same reference numerals.

The flexible rail $F_2$ comprises rectangular hollow rail pieces $R_0$ to $R_n$ and horizontal connecting plates $S_1$ to $S_n$ As with the first embodiment, all the rail pieces except the extreme ones $R_0$ and $R_n$, namely the intermediate rail pieces $R_1$ to $R_{n-1}$, have identical shapes.

FIG. 14 depicts one of the intermediate rail pieces. As depicted, the intermediate rail piece has a rectangular hollow shape, and has opposed bottom lips 27 which are spaced apart from each other. As with the first embodiment, the intermediate rail piece has a concave front end face 29 and a convex rear end face 28.

As with the first embodiment, although not shown, the foremost rail piece $R_0$ has a shape identical to that of the intermediaterail piece except that the foremost rail piece $R_0$ has a flat or straight front end face. Also, although not shown, the rearmost rail piece $R_n$ has a shape identical to that of the intermediate rail piece except that the rearmost rail piece $R_n$ has a flat or straight rear end face.

The rail pieces are connected together by horizontal connecting plates $S_1$ to $S_n$. All the connecting plates have identical shapes except that the foremost connecting plate $S_0$ (not shown) has no bottom recess.

As described before, the connecting plate of the flexible rail $F_1$ has an angular front end and a straight rear end 22. However, as illustrated in FIG. 14, the connecting plate of the flexible rail $F_2$ has ridged front and rear ends. That is, the front end of the connecting plate includes inclined faces 30, 30 which form a central ridge 30A. Similarly, the rear end of the connecting plate includes inclined faces 31, 31 which form a central ridge 31A. The inclined face inclines at an angle of 3 to 5 degrees. This angle is designated by the letter $\theta$. Adjacent connecting plates are in contact with each other at the ridges 30A and 31A thereof.

The connecting plate is fixed to the rail piece by means of a short bolt 14 or a long bolt 16 which are inserted into an opening 11 of the connecting plate and an opening 9 of the rail piece. For the same reason as in the first embodiment, it is necessary to fix some of the connecting plates to the rail pieces by means of the long bolts 16.

A pivotal bolt ($P_1$ to $P_n$) is inserted into a front opening 10 of the connecting plate and an opening 8A of the rail piece and, thus, serves to connect adjacent rail pieces together. A nut 32 is used in conjunction with the bolt ($P_1$ to $P_n$). As with the first embodiment, the pivotal bolt is fixed to the rail piece, but is not fixed to the connecting plate. The pivotal bolt is rotatable in the opening 10. Thus, as with the first embodiment, the pivotal bolt and the rail piece (to which the pivotal bolt is fixed), as one body, are capable of horizontal arcing motion relative to the adjacent rail pieces.

The opening 8A of the rail piece is located at the middle of the length direction of the top of the rail piece. A longitudinal centerline H—H of the flexible rail $F_2$ connects the centers of the openings 8A of the rail pieces.

As with the first embodiment, the convex rear end face 28 of the front one of adjacent rail pieces and the concave front end face 29 of the rear rail piece coincide with a curved line produced by drawing a circle with the radius X round the center of the opening 8A into which the pivotal bolt connecting the adjacent rail pieces is inserted.

As with the first embodiment, the rail piece and the connecting plate fixed thereto constitute an "arcing unit". Shortly after starting to arc (in a horizontal plane), however, the rear arcing unit is stopped, since one of the front inclined faces 30 of the connecting plate thereof engages with the adjacent rear inclined face 31 of the connecting plate of the front arcing unit. That is, the connecting plates of the arcing units limit the arcing motions thereof to small ranges by engaging with each other.

Thus it will be appreciated that the flexible rail $F_2$ also can flex as illustrated in FIGS. 2 and 13.

For example, a conveyor chain with side rollers or a universal chain can be carried on the flexible rail $F_2$. The opposed bottom lips support the chain.

As described before, the flexible rail $F_1$ can be effectively used for conveyance of relatively large or heavy objects. In contrast, the flexible rail $F_2$ is particularly adapted for conveyance of relatively small or lightweight objects.

It will be appreciated that, if desired, a connecting plate with a shape similar to that of the connecting plate of the flexible rail $F_1$, instead of the connecting plate of FIG. 14, may be used for the flexible rail $F_2$. Similarly, if desired, a connecting plate with a shape similar to that of the connecting plate of FIG. 14 may be used for the flexible rail $F_1$.

Variations of Rail Piece

Figure 17:
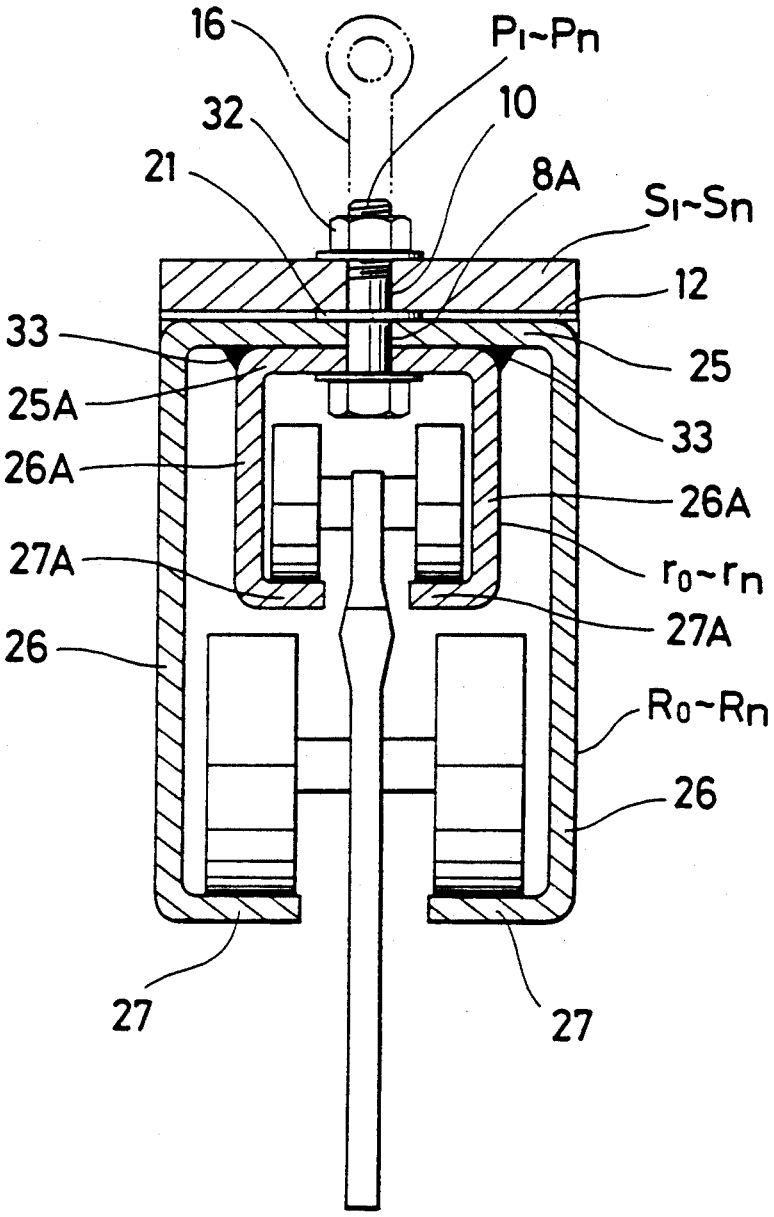
FIGS. 17, 18, and 19 show different rail pieces.

A rail piece of FIG. 17 has substantially the same construction as the rail piece of FIGS. 14 to 16, except that the rail piece of FIG. 17 comprises an outer, large shell construction similar to the rail piece of FIGS. 14 to 16 and an inner, small shell construction having a shape similar to that of the outer shell construction. The inner shell construction is welded to the top of the outer shell construction as indicated at 33. A conveyor chain may be carried on (opposed bottom lips 27A of) the inner shell construction. A trolley may be carried on (opposed bottom lips 27 of) the outer shell construction.

Figure 18:
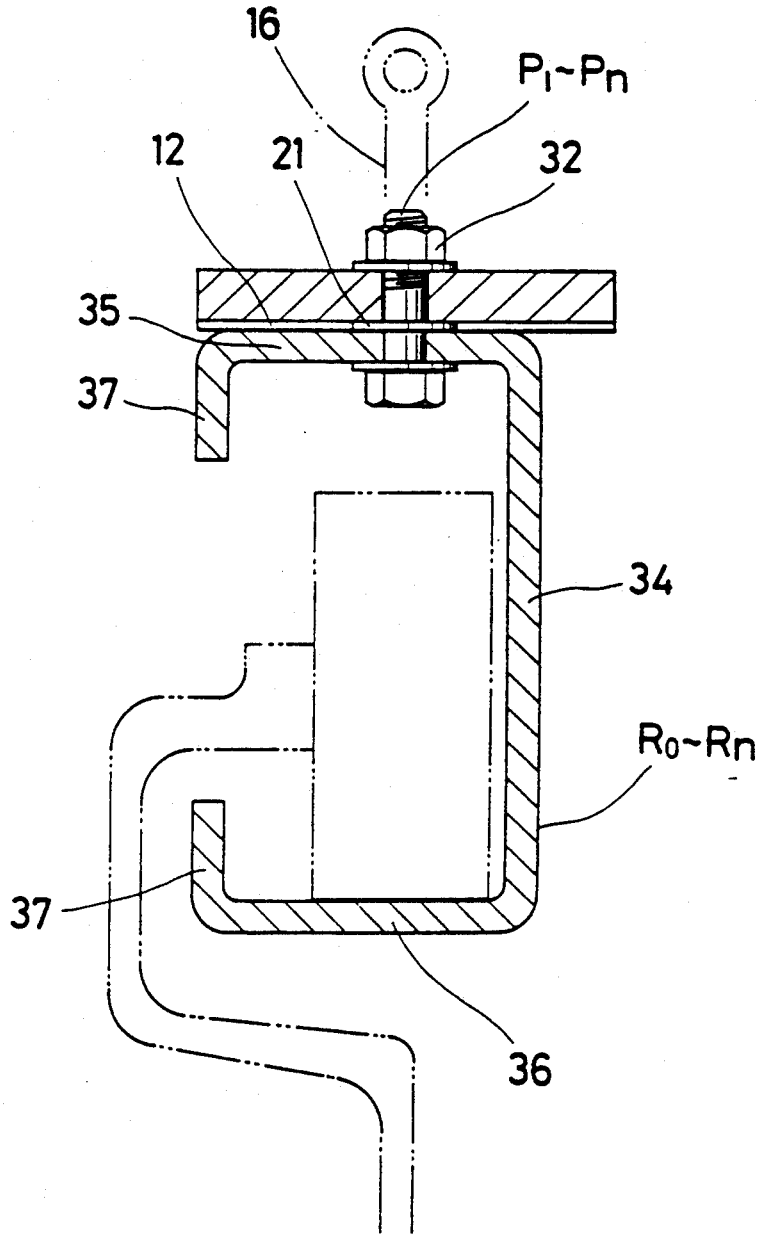

FIG. 18 shows a generally C-shaped rail piece which can also be used to provide a flexible rail according to the invention. A pivotal bolt ($P_1$ to $P_n$) is located at the center of gravity of the rail piece. A chain conveyor can be carried on the rail as indicated by a dotted line.

Figure 19:
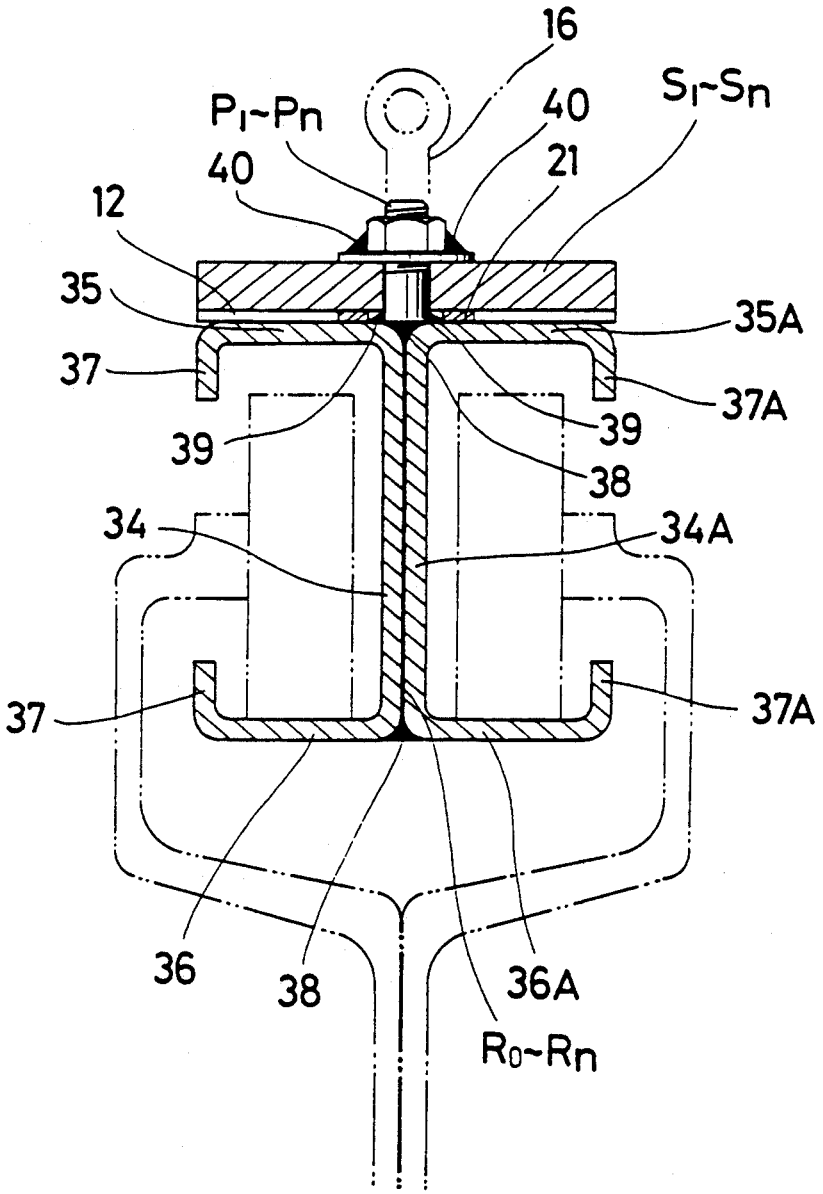

FIG. 19 shows another rail piece which can be used to provide a flexible rail according to the invention. As illustrated, the rail piece of FIG. 19 comprises two generally C-shaped constructions welded together at 38. In manufacture of such a flexible rail, the bottom of a pivotal bolt ($P_1$ to $P_n$) is first welded to the rail piece as indicated by reference numeral 39, and then a connecting plate ($S_1$ to $S_n$) with an-opening 10 is placed on the rail piece in such a manner that the pivotal bolt projects from the opening 10. Then, the head of the pivotal bolt is welded to the connecting plate as indicated by reference numeral 40.

Moreover, although not shown, an H-shaped rail piece can also be used to provide a flexible rail according to the invention.

All the above-mentioned rail pieces can be obtained by cutting commercially available shape steels. For example, a number of rail pieces of FIG. 5 can be obtained by cutting an I-steel. Also, a number of rail pieces of FIG. 14 can be obtained by cutting a lip channel steel. However, if desired, any one of the above-mentioned rail pieces can be provided individually. For example, a rail piece can be cast.

What is claimed is:

1. A single-line system for coating parts, such as automobile parts or electrical parts with paint, which comprises plural coating sections ($D_1$ to $D_3$) each housing plural coating booths ($E_1$ and $E_2$, $E_3$ and $E_4$, $E_5$ and $E_6$), horizontally-movable nonflexible rails ($K_2$) located in the respective coating sections portions thereof, a first fixed nonflexible rail for introducing parts to be coated into a first coating section ($D_1$), intermediate fixed nonflexible rails located between the coating sections, a last fixed nonflexible rail for discharging the parts from a last coating section ($D_3$), all said nonflexible rails being arranged in series, horizontally-flexible rails located between the nonflexible rails to connect the nonflexible rails, means for suspending the movable nonflexible rail ($K_2$), means for suspending the horizontally-flexible rail, trolleys which run suspended from the nonflexible and flexible rails, and plural operating means each provided in conjunction with one of the coating sections ($D_1$ to $D_3$) for moving the movable nonflexible rail ($K_2$) transversely in a horizontal plane to selectively locate the nonflexible rail ($K_2$) in one of the coating booths, each of the flexible rails comprising (i) rail pieces ($R_0$ to $R_n$) which are in contact with each other, intermediate ones ($R_1$ to $R_{n-1}$) of the rail pieces each having a concave front end face and a convex rear end face and being in contact with adjacent rail pieces at its concave front end face and its convex rear end face, respectively, a foremost one ($R_0$) of the rail pieces having a straight or flat front end face and a convex rear end face and being in contact with the adjacent rail piece ($R_1$) at its convex rear end face, and a rearmost one ($R_n$) of the rail pieces having a concave front end face and a straight or flat rear end face and being in contact with the adjacent rail piece ($R_{n-1}$) at its concave front end face, (ii) connecting plates ($S_0$ to $S_n$) for connecting the rail pieces ($R_o$ to $R_n$) together, each of the connecting plates ($S_1$ to $S_n$) except a foremost one ($S_0$) bridging adjacent rail pieces, (iii) means for fixing each of the connecting plates ($S_1$ to $S_n$) except the foremost connecting plate ($S_0$) on a top of one of adjacent rail pieces, (iv) pivotal connecting means ($P_1$ to $P_n$) located along a longitudinal centerline of the flexible rail for connecting each of the connecting plates ($S_1$ to $S_n$) to the other one of the adjacent rail pieces such that the connecting plate, together with the rail piece to which the connecting plate is fixed, can move in an arc, in a horizontal plane, relative to the other one of the adjacent rail pieces, and the pivotal connecting means thus connecting the adjacent rail pieces together for relative arcing motion, (v) means for fixing the foremost connecting plate ($S_0$) on a top of the foremost rail piece ($R_0$), (vi) arcing-motion limiting means for limiting the arcing motion of the connecting plate to a relatively small range, (vii) the convex rear end face of each of the intermediate rail pieces ($R_1$ to $R_n$) and the concave front end face of the adjacent rail piece which is in contact therewith, coinciding with a curved line produced by drawing a circle with a predetermined radius round a center of an opening of the rail piece into which the pivotal connecting means connecting the adjacent rail pieces together is inserted, (viii) the convex rear end face of the foremost rail piece ($R_0$) and the concave front end face of the rail piece ($R_1$) located immediately behind the foremost rail piece ($R_0$), coinciding with a curved line produced by drawing a circle with a first given radius round a center of an opening of the foremost rail piece into which the pivotal connecting means connecting the foremost rail piece and the rail piece ($R_1$) together is inserted, and said first given radius being equal to said predetermined radius, and (ix) the concave front end face of the rearmost rail piece ($R_n$) and the convex rear end face of the rail piece ($R_{n-1}$) located immediately in front of the rearmost rail piece, coinciding with a curved line produced by drawing a circle with a second given radius round a center of an opening of the rail piece ($R_{n-1}$) into which the pivotal connecting means connecting the rearmost rail piece and the rail piece ($R_{n-1}$) together is inserted, and said second given radius being equal to said predetermined radius.

2. A single-line coating system in accordance with claim 1 wherein the means for suspending the horizontally-flexible rail lateral guide means (48), and short longitudinal guide rails (53) suspended from the lateral guide rails (48) for suspending the flexible rail such that the rail pieces can slightly move in a longitudinal direction during flexure of the flexible rail.

3. A single-line coating system in accordance with claim 1 wherein each of the rail pieces ($R_0$ to $R_n$) is a generally I-shaped rail piece.

4. A single-line coating system in accordance with claim 1 wherein each of the rail pieces ($R_0$ to $R_n$) is a rectangular hollow rail piece with open front and rear ends and with opposed bottom lips which are spaced apart from each other.

5. A single-line coating system in accordance with claim 1 wherein each of the rail pieces ($R_0$ to $R_n$) comprises (a) a large rectangular hollow rail piece with open front and rear ends and with opposed bottom lips (27) which are spaced apart from each other and (b) a small rail piece located inside the large rail piece and having a shape similar to that of the large rail piece, the small rail piece being fixed to a top of the large rail piece.

6. A single-line coating system in accordance with claim 1 wherein each of the rail pieces ($R_0$ to $R_n$) is a generally C-shaped rail piece.

7. A single-line coating system in accordance with claim 1 wherein each of the rail pieces ($R_0$ to $R_n$) comprises a pair of generally C-shaped rail pieces having inner vertical walls (34, 34A) fixed together.

8. A single-line coating system in accordance with claim 1 wherein the connecting plates ($S_0$ to $S_n$) are slightly spaced apart from each other, and each of the connecting plates ($S_0$ to $S_n$) has a trapezoidal front end with a central straight face (23) and inclined side faces (24) and a straight rear end (22), one of the inclined faces (24) of a rear one of adjacent connecting plates and the straight rear end (22) of a front one of the adjacent connecting plates providing said arcing-motion limiting means by engaging with each other.

9. A single-line coating system in accordance with claim 1 wherein each of the connecting plates ($S_0$ to $S_n$)

has a ridged front end with inclined faces (30) which form a central ridge (30A) and a ridged rear end with inclined faces (31) which form a central ridge (31A), and the connecting plates ($S_0$ to $S_n$) are in contact with each other at the central ridges (30A and 31A) thereof, one of the inclined faces (30) of one of adjacent connecting plates and the opposed inclined face (31) of the other of the adjacent connecting plates providing said arcing-motion limiting means by engaging with each other.

* * * * *